United States Patent [19]

Braud et al.

[11] Patent Number: 4,848,752

[45] Date of Patent: Jul. 18, 1989

[54] APPARATUS FOR THE INSIDE AND OUTSIDE QUENCHING OF TUBULAR PIECES

[75] Inventors: Yves Braud, Maurepas; Jean Fromentin, Paris; Maurice Simonnot, Montrouge, all of France

[73] Assignee: Stein Geurtey, Ris Orangis, France

[21] Appl. No.: 109,168

[22] Filed: Oct. 16, 1987

[30] Foreign Application Priority Data

Oct. 22, 1986 [FR] France ..... 86 14655

[51] Int. Cl.[4] ..... C21D 9/08

[52] U.S. Cl. ..... 266/114; 266/259

[58] Field of Search ..... 266/114, 117, 259

[56] References Cited

U.S. PATENT DOCUMENTS

| | | | |
|---|---|---|---|
| 2,287,825 | 6/1942 | Postlewaite | 266/114 |
| 2,307,694 | 1/1943 | Malke | 134/122 R |
| 2,565,855 | 8/1951 | Jordan | 134/64 |
| 3,623,716 | 11/1971 | Fritsch et al. | 148/153 |
| 4,123,301 | 10/1978 | Pope et al. | 148/143 |
| 4,376,528 | 3/1983 | Ohshimatani et al. | 266/114 |
| 4,486,009 | 12/1984 | Kopf | 266/114 |
| 4,575,054 | 3/1986 | Kruppert | 266/114 |

FOREIGN PATENT DOCUMENTS

| | | | |
|---|---|---|---|
| 0065577 | 12/1982 | European Pat. Off. . | |
| 82872 | 3/1964 | France . | |
| 2344635 | 10/1977 | France . | |
| 37859 | 8/1985 | Japan | 266/130 |

*Primary Examiner*—Christopher W. Brody

*Attorney, Agent, or Firm*—Sandler & Greenblum

[57] ABSTRACT

An apparatus for providing the inner and outer quenching of tubular metallic pieces and more particularly of steel tubes, characterized in that it includes successively in the direction of movement of said tubes:

a series of primary quenching annuli through which progresses the tube to be quenched, a weir tank filled with quenching liquid and formed with an inlet orifice for the tube to be quenched, said orifice being provided with a tight closing shutter and at least on high pressure quenching annulus, a plurality of guiding cylinders and rollers placed in the weir tank for the rotating progress of the tube travelling through the tank, means for providing for the inner quenching under pressure of the tube travelling through the tank and means for the recovery of the quenching liquid discharged from the weir tank, its filtration, its return and new rises in pressure for, on the one hand feeding the tank and, on the other hand, feeding under a high pressure the quenching annuli and inner pressure quenching means.

9 Claims, 2 Drawing Sheets

APPARATUS FOR THE INSIDE AND OUTSIDE QUENCHING OF TUBULAR PIECES

BACKGROUND OF THE INVENTION

This invention relates to an apparatus for providing for the inside and outside quenching of tubular metallic pieces, and more particularly of steel tubes. It is known that in the production of steel tubes, quenching is particularly important qualitative element and is the cause of a number of technical problems difficult to solve. Amongst such problems can be cited in particular:

(a) obtaining a good homogeneity between the inner quenching and the outer quenching;

(b) obtaining a minimum deformation during quenching;

(c) providing an excellent surface state.

Generally, the quenching installations for metallic tubular products presently realized do not allow for satisfactory solving the totality of the technical problems. The present invention aims at providing a quenching apparatus adapted for obtaining a quenching quality superior to that obtained with the various existing systems.

SUMMARY OF THE INVENTION

Consequently, this invention relates to an inner and outer quenching apparatus for tubular pieces, notably steel tubes, characterized in that it includes successively in the direction of movement of the tubes:

a series of primary quenching annuli through which progresses the tube to be quenched, a weir tank filled with quenching liquid and formed with an orifice for the tube, said orifice being provided with a closing shutter and at least one high pressure quenching annulus, a plurality of guiding cylinders or rollers placed in the weir than for the rotating progress of the tube travelling through the tank, means providing the inner quenching under pressure of the tube travelling through the tank and means for the recovery of the quenching liquid discharged from the weir tank, its filtration and its return and new rise in pressure for, on the one hand, feeding the tank and, on the other hand, feeding under a high pressure the quenching annuli and the inner pressure quenching means.

According to a feature of this invention, the means providing for the inner quenching under pressure of the tube travelling through the weir tank is in the form of a retractable lance introduced through the bore of the tube and fed with quenching liquid under pressure, said quenching liquid being injected in the tube preferably in the direction of movement of the latter in the weir tank.

According to another feature of this invention, one foresees eventually in the weir tank a series of secondary quenching annuli fed with quenching liquid under a high pressure, the annuli being used for increasing the outer quenching effect as a function, notably, of the tint, the diameter and thickness of the tubes to be quenched.

According to another feature of this invention, and for avoiding any possibility of an inner quenching quicker than the outer quenching, the primary quenching annuli are set in operation in a rythmic way, from downstream to upstream when considering the direction of movement of the tube in the apparatus, as the penetration of the latter proceeds in the weir tank.

Other features and advantages of this invention will become more apparent from the hereafter description made in reference with the accompanying drawings illustrating an embodiment thereof without any limiting character.

DETAIL DESCRIPTION OF THE INVENTION

Figure 1:
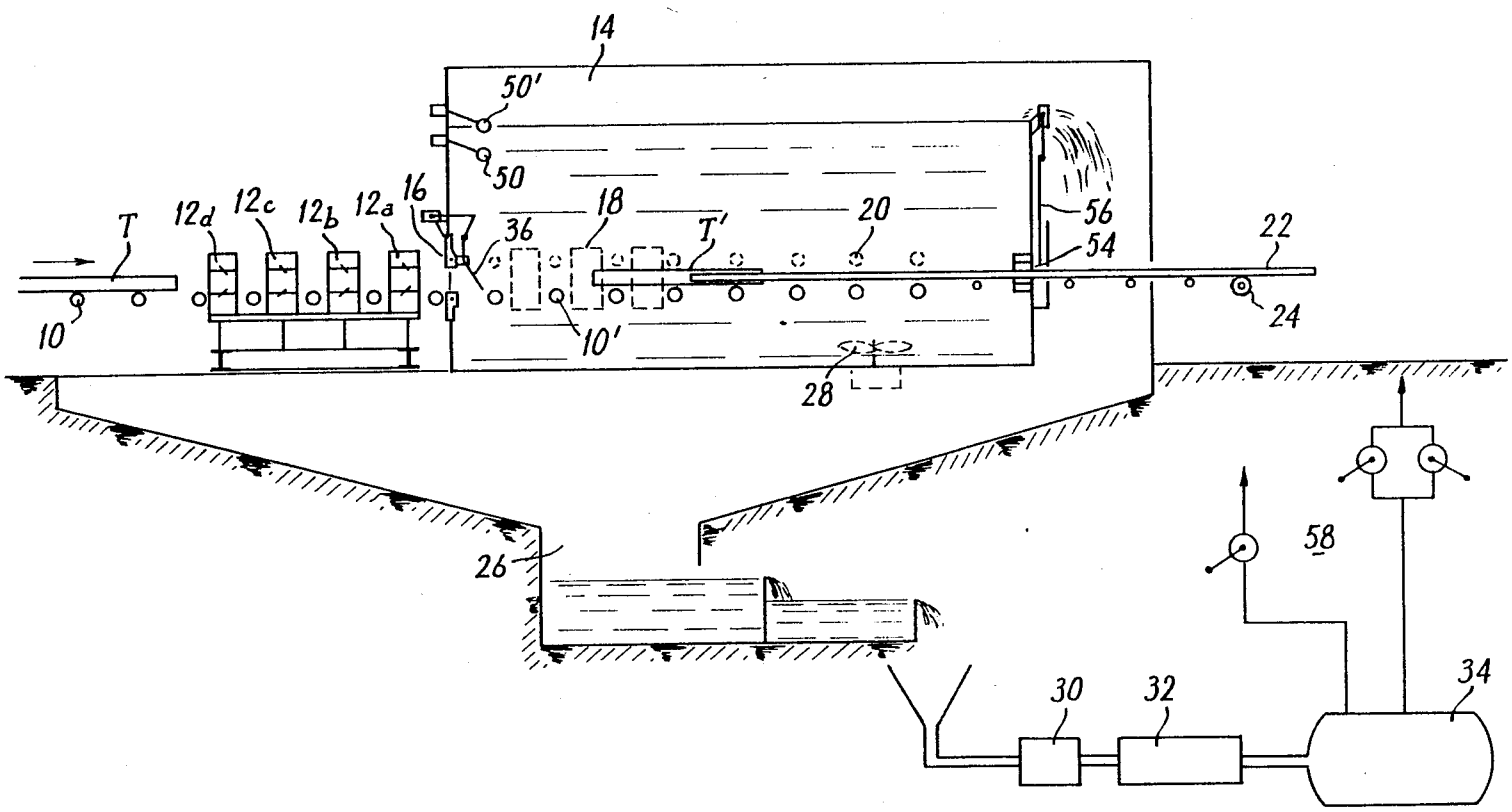
FIG. 1 is a schematic view in side elevation and longitudinal section of a quenching apparatus according to this invention.

With reference to the drawings, one sees that the quenching apparatus which is the object of this invention includes a series of primary quenching annuli 12*a*, 12*b*, 12*c*, 12*d* through which passes the tube T to be quenched, which moves on guiding cylinders 10 in a known manner. Said outer primary quenching annuli can be of any type, as for example tangential or with a lip.

Following this series of primary quenching annuli, in the direction of movement of the tubes T, the apparatus includes a weir tank 14 containing the quenching liquid, through which said tubes T are displaced, the length of the tank 14 being greater than that of a tube T to be quenched. The level of the quenching liquid (for example water) is maintained constant with the assistance of a regulation system of a standary type actuated by top 50' and bottom 50 floats.

There is mounted at the inlet of weir tank 14 a high pressure and large flow rate quenching annulus 16 and a shutter or flap 36 providing for the tight closing of the inlet orifice of tube T in the tank. There is foreseen a control system, for example using photocells, for the opening of shutter 36 and for the setting in operation of inlet annulus 16.

Figure 2:
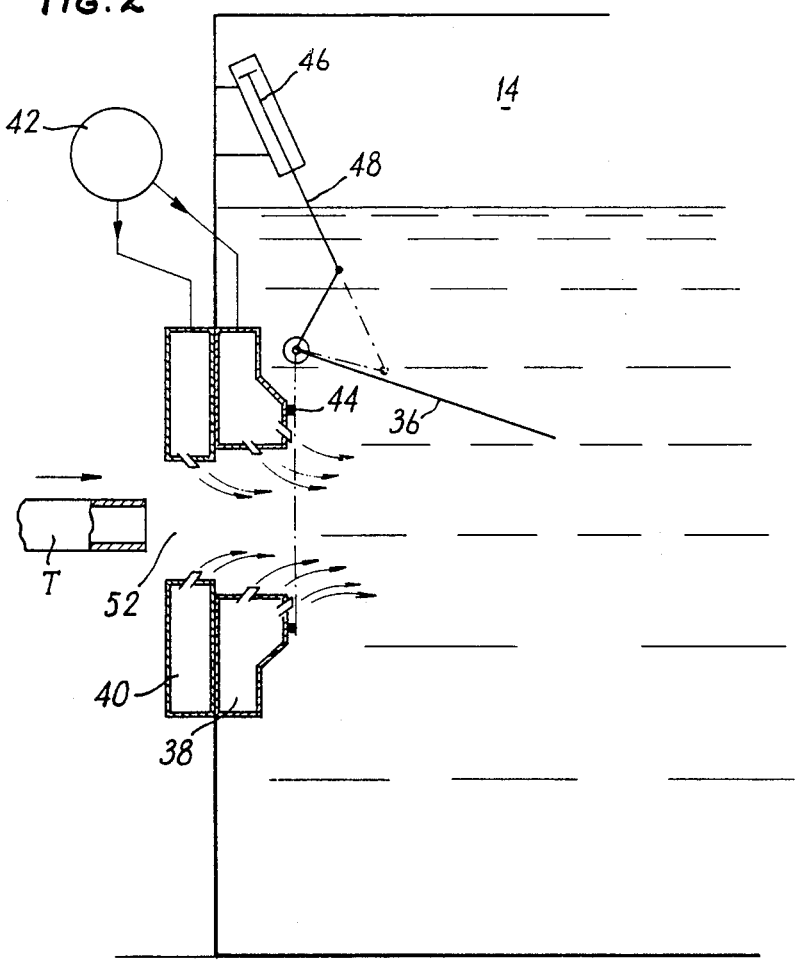
FIG. 2 is a detailed view at a larger scale showing the inlet orifice of the weir tank.

In the embodiment shown in FIG. 2, the orifice of weir tank 14 includes two inlet annuli 38 and 40. Annulus 38 is a fixed high pressure annulus and annulus 40 is of the high pressure type with a diameter settable as a function of that of the tubes to be quenched. Annuli 38 and 40 are fed under a high pressure via a duct 42. In said FIG. 2 is shown an example of a non limiting embodiment of the system providing for the opening and closing of shutter 36 which ensures the tight closing of the inlet orifice 52 of tank 14. The system includes substantially a ram 46 actuating an assembly of articulated connecting rods 48, at the end of which pivots vave 36. A sealing system such as 44 provides for the tightness.

There is moreover provided in the weir tank 14: means for effecting the inner quenching under pressure of tube T travelling through the tank, in the drawing said means being formed of a retractable lance 22 introduced through tube T in order to inject therein the quenching liquid under high pressure and, possibly, a plurality of high pressure secondary quenching annuli 18 and stirring blades such as 28.

Figure 3:
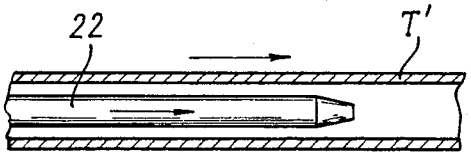
FIG. 3 illustrates an example using the lance providing the inner quenching under pressure.

In FIG. 1 is shown schematically at 24 the system provided by the invention for ensuring the retraction and shifting of the lance during the exit of tube T having been subjected to the inner quenching and to the outer quenching. Preferably (FIG. 3), lance 22 is placed in such manner that the quenching liquid is injected through bore of tube T' in the direction of movement of the latter through the weir tank 14.

In order to obtain a rotating progression of tube T' through the weir tank 14, there is disposed in said tank a series of inclined cylinders 10', similar to the outer cylinders 10, and possibly upper guiding rollers 20 for limiting the risk of a flection of the tube. Preferably, the lower cylinders 10, 10' and the upper guiding rollers 20 are coated with a suitable covering for avoiding marks on the tubes.

Moreover, the apparatus includes a recovery gutter 26 with decantation tanks and a filtration 30 and clarification 32 system. The quenching liquid to be recycled is stored in a tank 34 from which a rerun and pressure rise circuit 58 provides on the one hand for the low pressure feed of the weir tank 14, and on the other hand the high pressure feed of the primary quenching annuli 12*a*, 12*b*, 12*c* and 12*d*, of the inlet annulus or annuli 16, 38, 40 of the eventual secondary annuli 18 and of lance 22.

The operation of this apparatus is as follows: A tube T supported by the guiding cylinders 10 is presented at the inlet of the primary quenching annuli 12*a*, 12*b*, 12*c*, 12*d*, it crosses said annuli and occults the cell of the control system foreseen at the inlet 52 of the weir tank 14 which causes the opening of shutter 36 and the setting in operation of the large flow rate and high pressure inlet annulus 16 (or of the similar annuli 38, 40 of FIG. 2). Preferably, the tube penetrates the tank 14 at a speed between 1 and 3 m/sec.

The quenching liquid, for example water, flows inside tube T' under the effect of the pressure due to the (settable) height of liquid in the weir tank and, according to the tint, diameter and thickness of the tube to be quenched, one uses eventually the secondary quenching tubes 18 (for improving the efficiency of the outer quenching) and lance 22 (for improving the efficiency of the inner quenching).

Since the penetration speed of water inside tube T' is higher than the penetration speed of the tube in the weir tank 14, it may happen that the inside quenching is quicker than the outer quenching.

In order to avoid this disadvantage, the invention forsees a rythmic operation of the primary annuli from downstream to upstream (from 12*a* to 12*b*, 12*c* and 12*d*) as the petretation of the tube proceeds in tank 14. According to the invention, the number of primary annuli 12*a*, 12*b*, 12*c* and 12*d* is determined as a function of the most unfavourable case of the inner quenching speed with respect to the outer quenching speed in the weir tank 14.

The stirring blades, or similar, 28, provided in the weir tank 14, improve the heat exchange and the quenching quality. On the other hand, the length of tank 14 allows performing some sort of rotating reciprocating motion of tube T' in the tank, which stimulates the quenching homogeneity during its final phase, once the tube is completely inside the weir tank.

After the inner and outer quenching, the tube can exit:

either through the tank inlet orifice 52 by bringing back tube T' rearwardly on the train of cylinders 10', or out by the top of tank 14, with the assistence of handling arms or equivalent, or through an outlet orifice 54 formed in register with the inlet orifice 52, once lance 22 has been retracted, said outlet orifice 54 being equipped with a closing shutter 56 similar to shutter 36.

Obviously, this invention is not limited to the embodiments shown and/or described, and it encompasses all the variants thereof.

What is claimed is:

1. An apparatus for providing for the inner and outer quenching of tubular metallic pieces comprising, successively in the direction of movement of the tubes through said apparatus:

(a) a series of primary quenching annuli through which the tube to be quenched is passed;

(b) a weir tank filled with quenching liquid and having an inlet orifice in a wall thereof for receiving a tube to be quenched, said orifice being provided with a tight closing shutter and at least one high pressure quenching annulus;

(c) a plurality of guiding cylinders and rollers located in said weir tank for rotating the tube traveling through said tank;

(d) means for providing for the inner quenching, under pressure, of the tube traveling through said tank; and (e) means for recovering quenching liquid that is discharged from said tank, for filtering the quenching liquid and for recycling the quenching liquid into said tank through an inlet feed and through said quenching annuli and said means for providing for the inner quenching of the tube.

2. An apparatus according to claim 1, wherein the means providing for the inner quenching under pressure of the tube travelling through said weir tank is a retractable lance introduced through the bore of the tube and fed with quenching liquid under pressure, said quenching liquid being injected in the tube in the direction of movement of said tube in said weir tank.

3. An apparatus according to claim 1, wherein a series of secondary quenching annuli fed with quenching liquid under a high pressure, are provided in said weir tank in order to enhance the outer quenching effect as a function, notably, of the tint, the diameter and thickness of the tubes to be quenched.

4. An apparatus according to claim 1, wherein the primary quenching annuli are set in operation in a rythmic way, from downstream to upstream when considering the direction of movement of the tube in said apparatus, as the penetration of the tube proceeds in said weir tank.

5. An apparatus according to claim 1, further comprising two inlet annuli at the inlet of said weir tank:a fixed high pressure annulus and a high pressure annulus with a diameter adjustable as a function of that of the tubes to be quenched.

6. An apparatus according to claim 1, wherein the cylinders and the rollers between which move the tubes, are provided with a protective coating for avoiding any marks on the tubes.

7. An apparatus according to claim 1 including an exit means through which the tube may be removed from said tank, said exit means comprising said inlet orifice and means for moving the tube out of the tank through said inlet orifice.

8. An apparatus according to claim 1 including an exit means through which the tube may be removed from said tank, said exit means comprising means for removing the tube from the top of said tank.

9. An apparatus according to claim 1 including an exit means through which the tube may be removed from said tank, said exit means comprising an outlet orifice formed in a wall of said tank opposed to and aligned with said inlet orifice, said outlet orifice including a tight closing shutter.

* * * * *

UNITED STATES PATENT AND TRADEMARK OFFICE

CERTIFICATE OF CORRECTION

PATENT NO. : 4,848,752

DATED : July 18, 1989

INVENTOR(S) : Yves BRAUD et al

It is certified that error appears in the above-identified patent and that said Letters Patent is hereby corrected as shown below:

In the Abstract, line 10, change "on" to ——one——;
In the Abstract, line 18, change "rises" to ——rise——;
column 1, line 9, change "quenching is" to ——quenching is a ——;
column 1, line 39, change "than" to ——tank——;
column 1, line 65, change "rythmic" to ——rhythmic——;
column 2, line 53, change "vave" to ——shutter——;
column 3, line 44, change "rythmic" to ——rhythmic——;
column 3, line 63, change "assistence" to ——assistance——;
column 4, line 27 (i.e., in claim 2, line 1), change "the" to ——said—— after "wherein"; and
column 4, lines 40/41 (i.e., in claim 4, lines 2 and 3), change "rythmic" to ——rhythmic——.

Signed and Sealed this

Thirteenth Day of August, 1991

*Attest:*

HARRY F. MANBECK, JR.

*Attesting Officer*

*Commissioner of Patents and Trademarks*